US006786666B1

(12) United States Patent
Floyd-Williams et al.

(10) Patent No.: US 6,786,666 B1
(45) Date of Patent: Sep. 7, 2004

(54) FABRIC LOTION APPLICATOR

(76) Inventors: Maria A. Floyd-Williams, 515 K St., NE., Washington, DC (US) 20002; Natalie E. Taylor, 2614 39th St., NW., Washington, DC (US) 20002

( * ) Notice: Subject to any disclaimer, the term of this patent is extended or adjusted under 35 U.S.C. 154(b) by 0 days.

(21) Appl. No.: 10/465,231

(22) Filed: Jun. 20, 2003

(51) Int. Cl.[7] ..... A46B 11/00
(52) U.S. Cl. ..... 401/118; 401/8; 15/222
(58) Field of Search ..... 401/6–8, 118; 15/208, 109.1, 222, 227, 209.1

(56) References Cited

U.S. PATENT DOCUMENTS

| | | | | | |
|---|---|---|---|---|---|
| 1,488,332 | A | | 3/1924 | Foerg | |
| 1,598,574 | A | * | 8/1926 | Gibson | 401/8 |
| 2,730,745 | A | | 1/1956 | Norman | |
| 3,072,946 | A | * | 1/1963 | La Falce | 15/222 |
| 3,167,077 | A | * | 1/1965 | Bosko | 401/8 |
| 3,364,511 | A | * | 1/1968 | Martin | 15/222 |
| 3,674,374 | A | | 7/1972 | Jennings | |
| 3,699,980 | A | * | 10/1972 | Carpenter | 132/320 |
| 3,720,205 | A | | 3/1973 | Liebman | |
| 3,812,849 | A | | 5/1974 | Giunta | |
| 3,977,796 | A | * | 8/1976 | Gillespie et al. | 401/8 |
| 4,196,490 | A | | 4/1980 | Jonzon | |
| 4,906,118 | A | | 3/1990 | Crooks | |
| 5,013,171 | A | | 5/1991 | Almond, II | |
| 5,251,990 | A | | 10/1993 | Vought et al. | |
| 5,545,456 | A | | 8/1996 | Suida | |
| 5,736,213 | A | | 4/1998 | Meier | |
| 5,983,436 | A | * | 11/1999 | Mason et al. | 15/222 |
| 6,386,776 | B2 | * | 5/2002 | Scariano | 401/8 |

FOREIGN PATENT DOCUMENTS

| | | |
|---|---|---|
| GB | 278906 | 10/1927 |
| GB | 2 165 748 | 4/1986 |

* cited by examiner

*Primary Examiner*—Gregory L. Huson
*Assistant Examiner*—Huyen Le
(74) *Attorney, Agent, or Firm*—Richard C. Litman

(57) ABSTRACT

The fabric lotion applicator permits a user to apply a lotion to remote areas of the user's body. The applicator may be provided in a kit which includes a fabric lotion applicator, a carrying pouch, and a lotion bottle. The fabric lotion applicator includes a generally rectangular main body and two handles attached to a first and second end of the main body. A button is provided on a first side of the main body and a flexible loop is attached to the first end of the main body. The lotion applicator may be easily folded into a compact size and releasably held in that configuration by engagement of the button and the loop member. The pouch is configured to carry the fabric lotion applicator and the lotion bottle within a pouch cavity.

9 Claims, 7 Drawing Sheets

FABRIC LOTION APPLICATOR

BACKGROUND OF THE INVENTION

1. Field of the Invention

The present invention relates to a lotion applicator, and particularly to a lotion applicator that can be used for applying lotion to areas of the body which are difficult to reach.

2. Description of the Related Art

Applying lotion to some parts of one's body may be challenging if not impossible without the aid of a device. For example, the back and foot are often difficult to reach with one's hands, and in some cases they cannot be reached at all. Additionally, applying lotion to one's body with one's hands can be a messy and unpleasant undertaking causing the hands to become greasy and tacky. While in the past, devices having a belt or elongated strip have been used to apply or massage such hard to reach areas, such prior art devices are difficult to grasp and are not configured for individuals of all sizes. Thus, there is a need for a compact lotion applicator that can be used by all to reach otherwise inaccessible parts without undue effort and inconvenience.

U.S. Pat. No. 5,736,213, issued Apr. 7, 1998 to S. Meier, discloses an elongated body of generally smooth non-absorbent material with elastic handles on opposite ends thereof. The material itself is non-elastic, non-laminated, and non-woven.

U.S. Pat. No. 5,545,456, issued Aug. 13, 1996 to T. Suida, discloses an improved washcloth having a main body comprising two sheets of flexible material of differing porosity integrally secured together. A plurality of pockets are provided for the simultaneous insertion of soap and/or massaging utensils and other medicating items. The washcloth has gripping handles integrally knit to the opposing ends of the main body.

U.S. Pat. No. 5,251,990, issued Oct. 12, 1993 to E. Voight et al., discloses an applicator for use in placing skin products on a person's body, particularly the recessed areas of the back. The applicator comprises an elongated rectangular strip of flexible material having finger holes at each end.

U.S. Pat. No. 2,730,745, issued Jan. 17, 1956 to V. Norman, discloses a washcloth having an elongated strap and a loop on each of its ends. A pocket is provided in the middle of the strap for retaining a cake of soap. The strap is made by folding a piece of material in four equally sized sections and stitching the folds together at selected portions of the strap.

Other patents relating to devices for scrubbing, massaging, or applying a body lotion to hard-to-reach sections of the body include U.S. Pat. No. 5,013,171, issued May 7, 1991 to. A. W Almond (apparatus including a cylindrical housing retractably containing an elongate continuous web retractable therefrom); U.S. Pat. No. 4,906,118, issued Mar. 6, 1990 to S. G. Crooks (lotion applicator having a central cylindrical container including a right and left flexible strap diametrically secured to opposite vertical sides of the container); U.S. Pat. No. 4,196,490, issued Apr. 8, 1980 to G. Jonzon (a sponge for personal washing having a through slot for accommodating an elongated strap having handles at opposite ends); U.S. Pat. No. 3,812,849, issued May 28, 1974 to G. Giunta (a skin conditioning article having springy and pliable body of layers of nylon net fabric with a mesh of about one-eighth inch); U.S. Pat. No. 3,720,205, issued Mar. 13, 1973 to A. J. Liebman (a device for use by a person for rubbing across hard-to-reach sections of the body having an elongated tubular liquid absorbent body formed from a limp material); U.S. Pat. No. 3,674,374, issued Jul. 4, 1972 to D. E. Jennings (a scrubber made of open-meshed tulle-like nylon having flexible loop-shaped handles at its respective ends); U.S. Pat. No. 1,488,332, issued Mar. 25, 1924 to A. Foerg (a sponge having a fibrous hollow body open at both ends and handles at opposite ends of the body); U.K. Patent No. 278,906, published Oct. 20, 1927 (a back washing device made of a bland of pliable material having transverse end spreaders to keep it spread out); and Great Britain Patent No. 2,165,748, published Apr. 23, 1986 (a body care device for use on-the human body, which has a first side formed of a toweling material, and a second side formed of a net material).

None of the above inventions and patents, taken either singly or in combination, is seen to describe the instant invention as claimed. Thus a fabric lotion applicator solving the aforementioned problems is desired.

SUMMARY OF THE INVENTION

The fabric lotion applicator includes a generally rectangular main body and two handles attached to first and second ends of the main body. The main body is formed from a single sheet of flexible fabric which is folded into three equally sized layers. The folded body is held in assembly, preferably by a seam which is sewn along the edges of the body. A button is provided on a first surface of the main body and a flexible loop is attached to the first end of the main body. When not in use, the lotion applicator may be easily folded into a compact size and releasably held in that configuration by engagement of the button and the loop member.

Also provided is a pouch for storing the lotion applicator. The pouch has an opening which may be releasably sealed by hook-and-loop fastening material that is affixed to the top edges of the pouch. A lotion bottle and a strap for securing the lotion bottle within the pouch are also included.

Accordingly, it is a principal object of the invention to provide a lotion applicator which can be used to apply-lotion to a user's back or to other areas of a user's body which are difficult to reach.

It is another object of the invention to provide a lotion applicator which is flexible and can be used by individuals of varying body size.

It is a further object of the invention to provide a lotion applicator that will not allow lotion to drip from the applicator surface.

It is yet another object of the invention to provide a lotion applicator that will not unduly absorb lotion that is applied thereon.

Still another object of the invention is to provide a lotion applicator which can be easily washed and dried.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
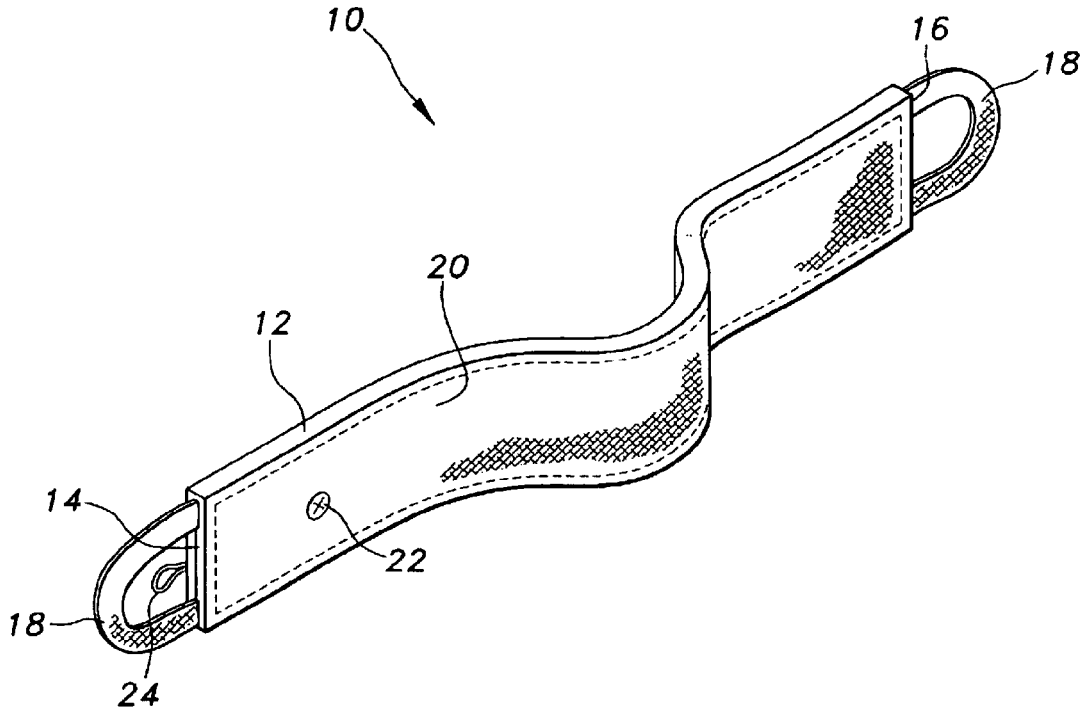
FIG. 1 is an environmental, perspective view of a fabric lotion applicator according to the present invention.

The present invention relates to a fabric lotion applicator, generally designated as 10 in the drawings. As shown in FIG. 1, the lotion applicator 10 includes a generally rectangular main body 12 having a first end 14 and an opposing second end 16. A handle 18 is provided at each of the first and second ends, 14 and 16. A flexible loop member 24 is attached to the first end 14 of the applicator 10. The front side 20 of the applicator 10 includes a button 22 proximate the first end 14 of the applicator 10.

Figure 2:
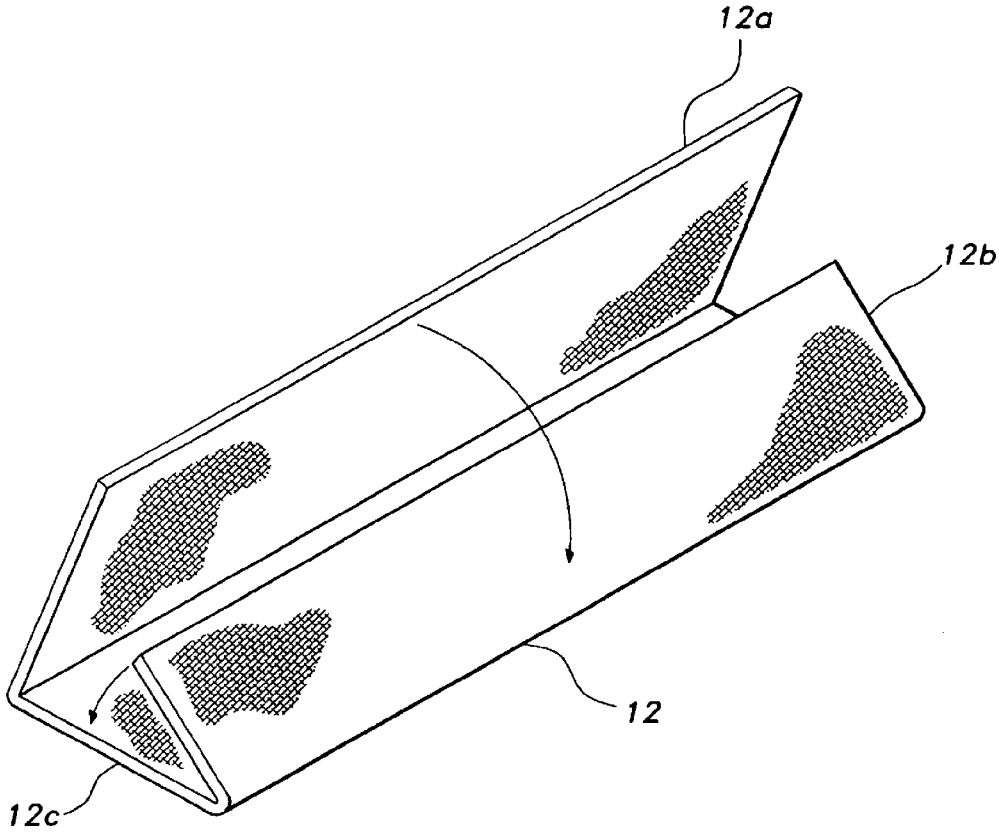
FIG. 2 is a perspective view of the applicator body of the fabric lotion applicator according to the present invention showing the manner of folding the applicator body during manufacture.
Figure 3:
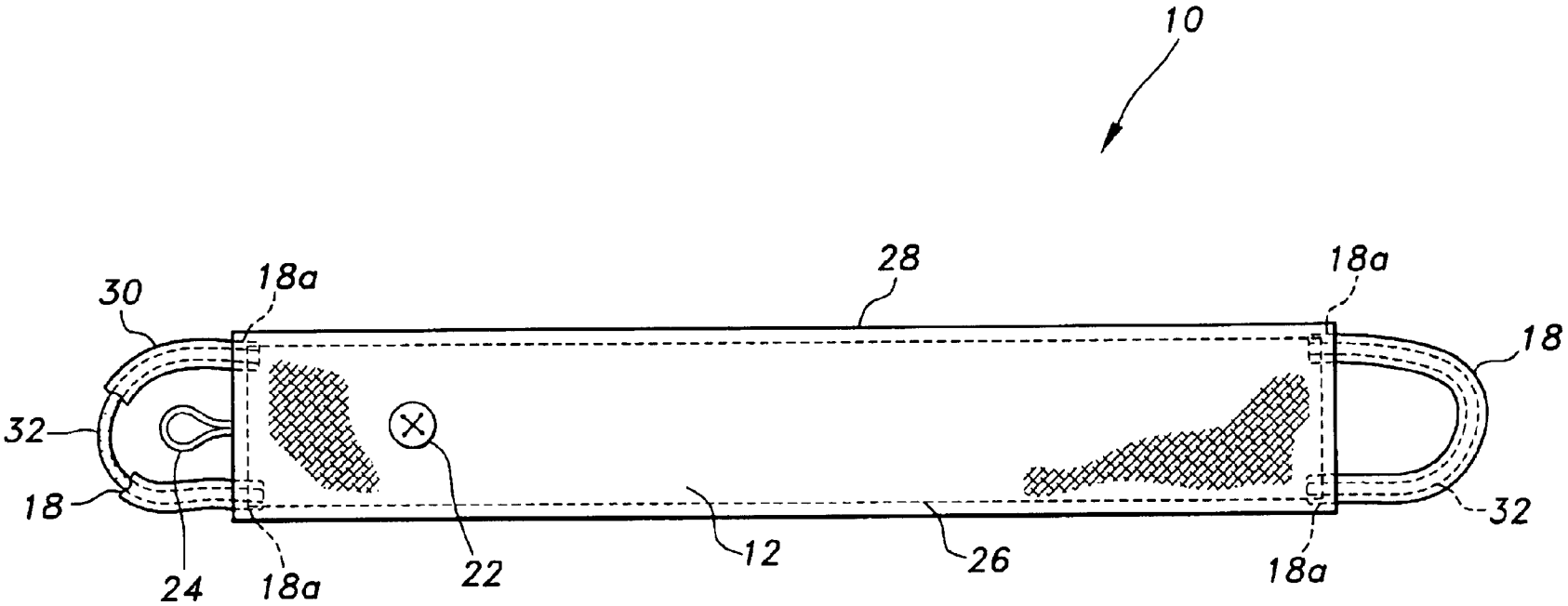
FIG. 3 is a front view of the fabric lotion applicator according to the present invention.

The body 12 is made from a single sheet of flexible fabric which is folded twice to form three overlapping panels, 12*a*, 12*b*, and 12*c*, of approximately equal size, as shown in FIG. 2. As shown, in FIG. 3, the folded body has a peripheral edge 28 defining the perimeter of the rectangular main body 12. The folded body 12 is held in assembly, preferably by a seam 26 which is sewn along the peripheral edge 28. Thus, the body 12 is flat with three overlapping layers, 12*a*, 12*b*, and 12*c*, joined at the edges, but otherwise slidable with respect to each other. The three panels, 12*a*, 12*b*, and 12*c*, when fixed together in this manner provide the body 12 with a significant degree of durability so that for example, the applicator 10 may withstand repeated washes without separating, as frequently occurs with laminated materials. Such a construction also maintains the flexibility of the fabric and retains the absorbency needed to prevent lotion from dripping from the applicator surface.

Each of the two handles 18 is preferably made from a single strip 30 of flexible fabric, and a resilient elastic band 32 or strap that is enveloped by the fabric strip 30. The handles 18 are attached to the first and second ends, 14 and 16, respectively, of the main body 12. Preferably, the opposing ends 18*a* of each handle 18 are sewn into the edge seam 26 of the first and second ends, 14 and 16.

The loop member 24 is preferably made from a flexible, resilient, elastic fabric band or strap. The loop member 24 is preferably sewn into the edge seam 26 of the first end 14. The loop member 24 is configured to engage the button 22 when the applicator 10 is folded.

Figure 4:
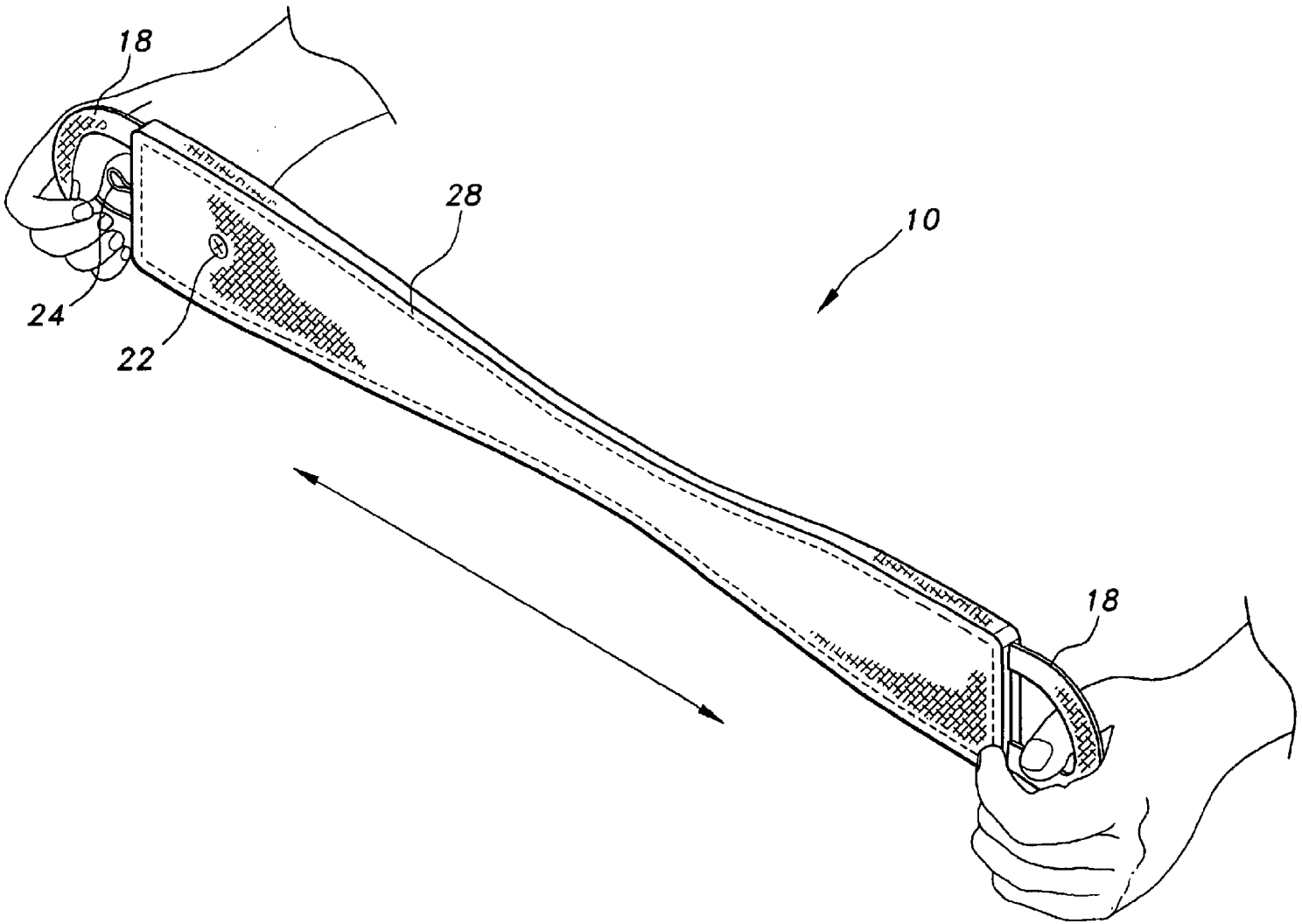
FIG. 4 is a perspective view of the fabric lotion applicator according to the present invention when the fabric lotion applicator is stretched.

While any suitable flexible fabric may be used, preferably, both the applicator body and handle strip 30 are made from a blend of cotton and spandex material, such as Lycra™. A fabric containing 90% cotton and 10% Lycra is particularly suitable for achieving the desired degree of flexibility and absorbency. Such a blend of fabrics is slightly absorbent, permitting application of the lotion without allowing the lotion to drip from the surface of the applicator 10. Additionally, the flexibility of such fabric allows the applicator 10 to be stretched, if necessary, to accommodate persons of different sizes. FIG. 4 depicts the lotion applicator 10 the lotion applicator in a stretched configuration.

Figure 5:
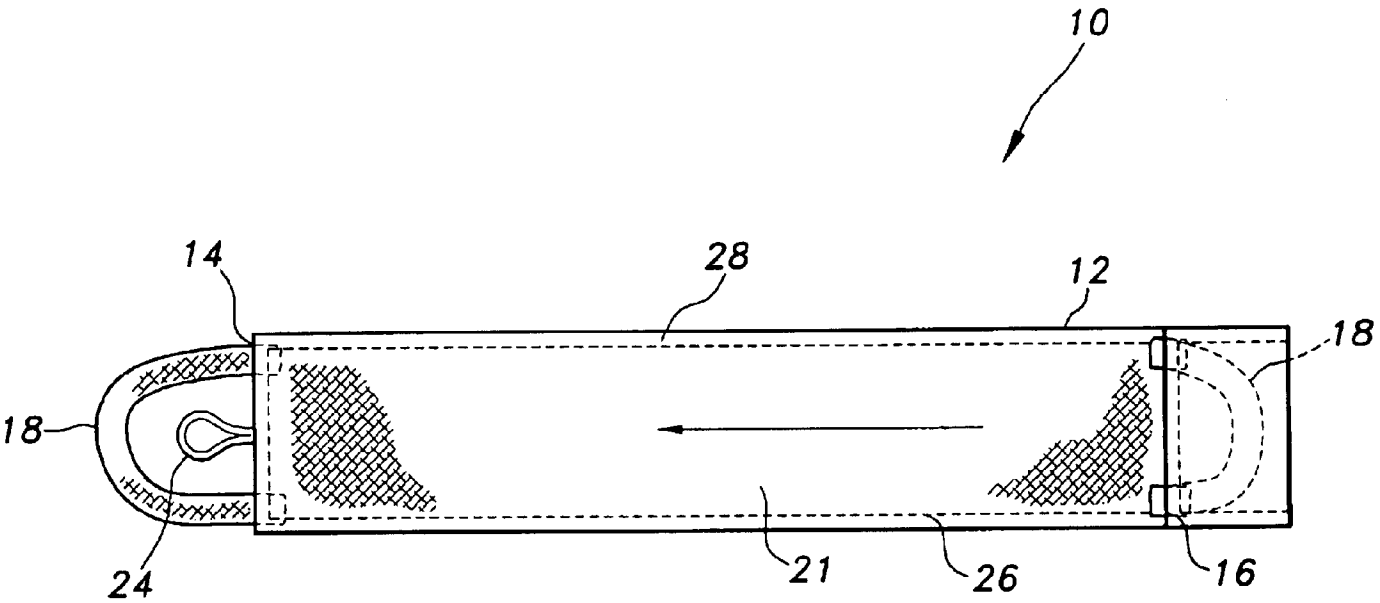
FIG. 5 is a rear view of the fabric lotion applicator according to the present invention showing the process of folding the applicator for storage.
Figure 6:
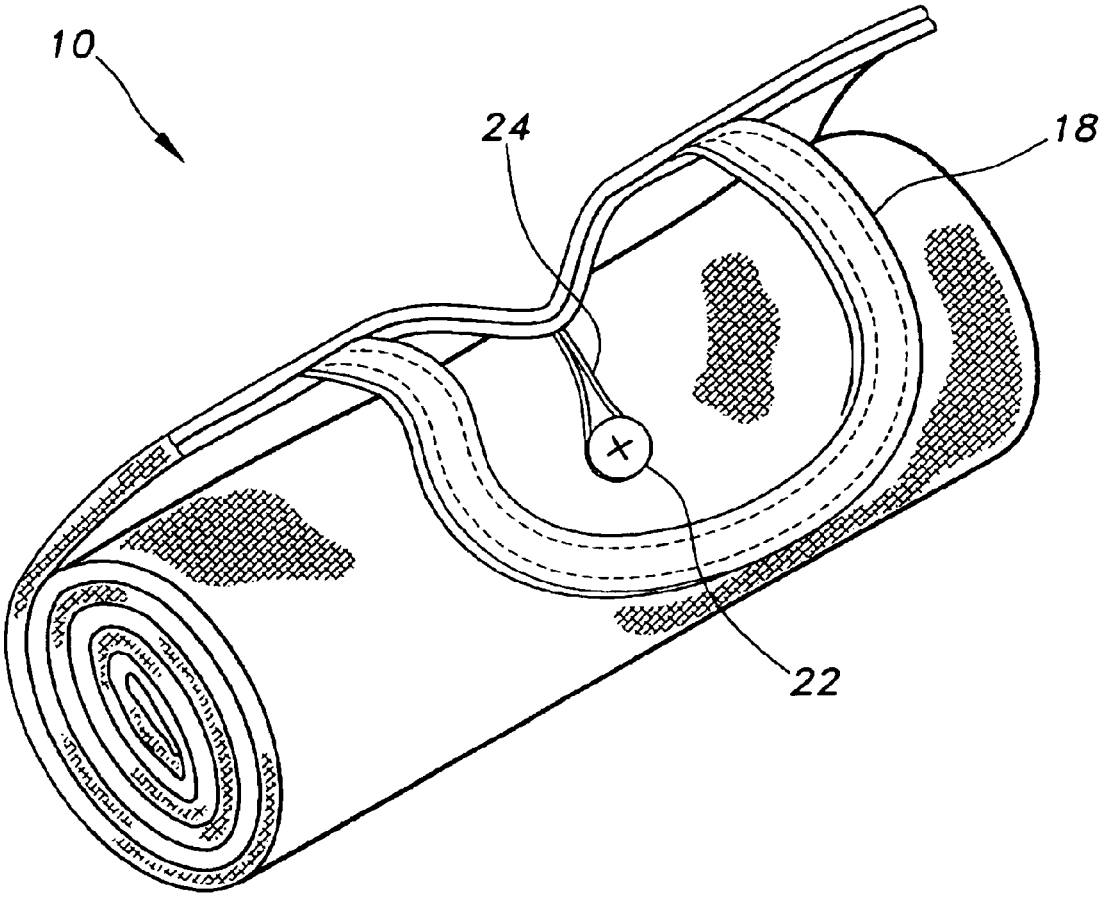
FIG. 6 is a perspective view of the fabric lotion applicator when the fabric lotion applicator is in a folded configuration.

When not in use, the lotion applicator 10 may be rolled up or folded into a compact size. The second end 16 of the lotion applicator 10 is folded into the rear side 21 of the applicator 10, as shown in FIG. 5, and the applicator 10 is rolled up. Thus, the button 22 remains exposed when the applicator 10 is completely folded, as shown in FIG. 6. By stretching the loop 24 over the button 22, the applicator 10 can be releasably held in a folded configuration.

Figure 7:
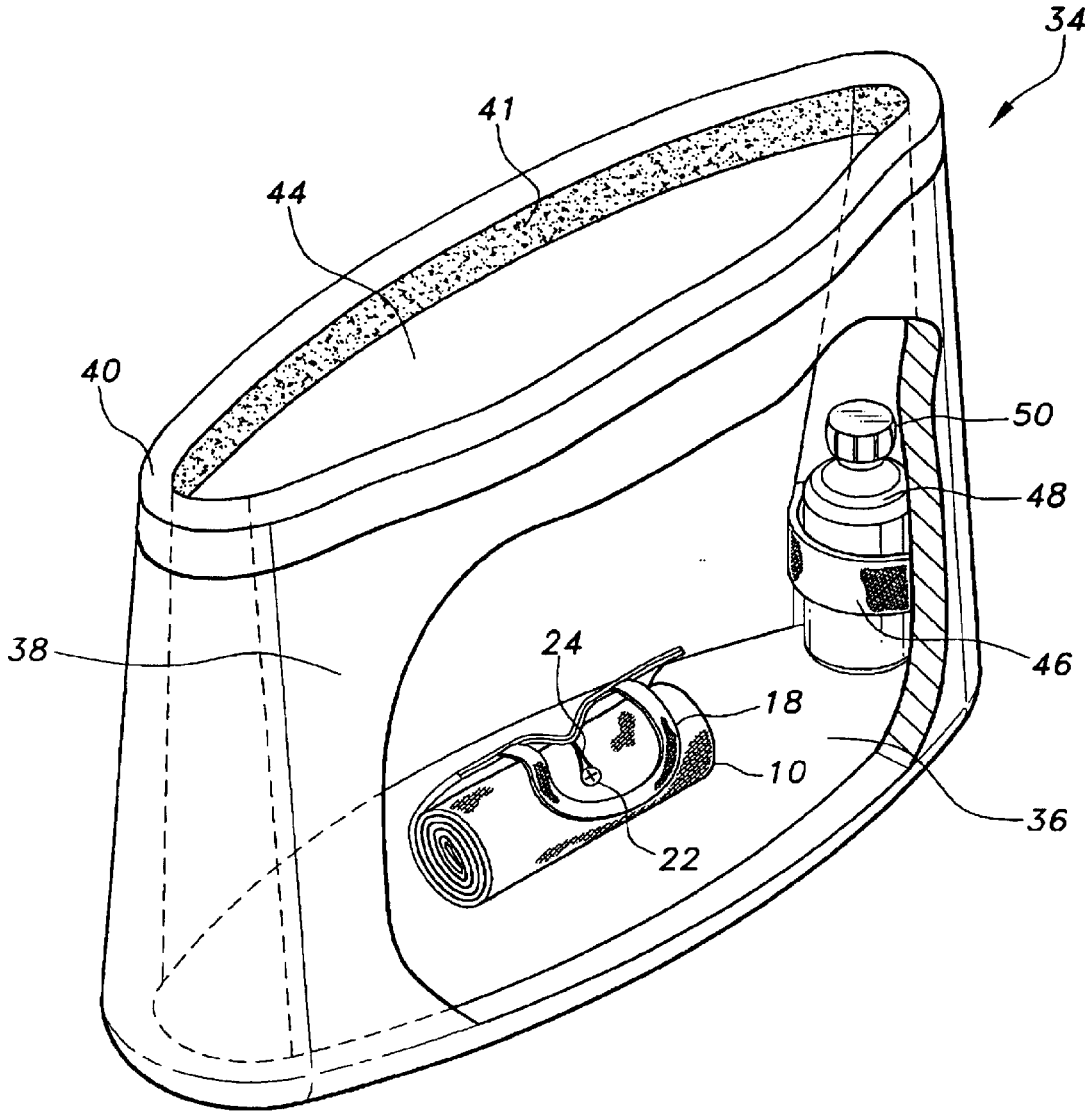
FIG. 7 is a fragmented view of the carrying pouch-according to present invention with the fabric lotion applicator and lotion bottle in the pouch cavity.

Also provided is a pouch 34 for storing the lotion applicator 10, as shown in FIG. 7. The pouch 34 has a peripheral wall 38 which forms the pouch cavity 36, and a peripheral wall top edge 40 which forms the pouch opening 44. The top edge 40 of the pouch 34 is provided with hook-and-loop fastening material 41 so that the pouch opening 44 can be releasably sealed. Preferably, the peripheral wall 38 is made from plastic vinyl coating and the pouch cavity 36 is lined with polyester. However, the pouch 34 may be made from any other suitable material.

Affixed to the interior compartment 36 of the pouch 34 is a bottle strap 46. While any suitable, flexible material can be used, preferably, the bottle strap 46 is made from elastic. The bottle strap 46 is configured to encircle a compact lotion bottle 48 and hold the lotion bottle 48 in place within the interior compartment 36. The lotion bottle 48 is preferably a plastic bottle which has a removable cap 50.

It is to be understood that the present invention is not limited to the embodiments described above, but encompasses any and the embodiments within the scope of the following claims.

We claim:

1. A fabric lotion applicator, comprising:

a) a generally rectangular body having two opposing longitudinal sides and first and second ends, the body being formed from a flat, flexible fabric sheet folded into three overlapping panels of substantially equal size, the panels being joined to one another around a peripheral edge of the rectangular main body by a seam in order to form a three-layered main body having a front surface and a rear surface;

b) a pair of handles attached to the first and second ends; and c) a loop member attached to the first end of said body.

2. The fabric lotion applicator of claim 1, further comprising a button attached to the front surface of said main body proximate the first end, whereby the main body is formed into a roll and the loop stretched over the button for compact storage of the applicator.

3. The fabric lotion applicator of claim 1, wherein each said handle comprises an fabric strip and an elastic band, said fabric strip being wrapped around said elastic band.

4. The fabric lotion applicator of claim 1, wherein said body is made from a flexible fabric.

5. The fabric lotion applicator of claim 1, wherein said body and said handles are made a blend of cotton and spandex materials.

6. A fabric lotion applicator kit, comprising:

a) a fabric lotion applicator, said applicator having:

(i) a generally rectangular body having two opposing longitudinal sides and first and second ends, the body being formed from a flat, flexible fabric sheet folded into three overlapping panels of substantially equal size, the panels being joined to one another around a peripheral edge of the rectangular main body by a seam in order to form a three-layered main body having a front surface and a rear surface; and (ii) a pair of handles attached to the first and second ends;

b) a pouch having a fabric body defining a mouth and a pouch cavity and having a bottle strap affixed within said pouch cavity, said pouch cavity being dimensioned and configured to store said lotion applicator; and c) a lotion bottle disposed in the pouch cavity and releasably retained therein by said bottle strap.

7. The fabric lotion applicator kit of claim 6, further comprising a loop member attached to the first end of said main body.

8. The fabric lotion applicator kit of claim 7, further comprising a button attached to the front surface of said main body proximate the first end, whereby the main body is formed into a roll and the loop stretched over the button for compact storage of the applicator.

9. The fabric lotion applicator kit of claim 6, further comprising mating strips of hook and loop fastener material disposed in the mouth of said pouch, whereby said pouch is reclosable.

* * * * *